US006182948B1

(12) United States Patent
Brandeis

(10) Patent No.: US 6,182,948 B1
(45) Date of Patent: Feb. 6, 2001

(54) MODULAR GARDEN BORDER SYSTEM

(76) Inventor: Zeev Brandeis, 7 Alon Street, Rosh Aain 48560 (IL)

( * ) Notice: Under 35 U.S.C. 154(b), the term of this patent shall be extended for 0 days.

(21) Appl. No.: 09/373,960

(22) Filed: Aug. 13, 1999

(51) Int. Cl.[7] ..... E04H 17/16
(52) U.S. Cl. ..... 256/65; 256/19; 256/70
(58) Field of Search ..... 256/65, 70, 68, 256/59, 19, 11; 52/592.3, 592.5, 592.6; 47/33, 47

(56) References Cited

U.S. PATENT DOCUMENTS 4,022,436 * 5/1977 Thomas ..... 256/19 X
4,167,079 * 9/1979 Reiter ..... 256/19 X
4,415,292 * 11/1983 Alperson ..... 403/329 X
5,161,784 * 11/1992 Sader ..... 256/19 X
5,445,362 * 8/1995 Reppert ..... 256/19 X

FOREIGN PATENT DOCUMENTS

1545498 * 5/1979 (GB) ..... 256/65

* cited by examiner

*Primary Examiner*—Lynne H. Browne
*Assistant Examiner*—John R. Cottingham
(74) *Attorney, Agent, or Firm*—Greer, Burns & Crain, Ltd.

(57) ABSTRACT

A modular garden border system that divides a garden from another landscape area has at least one stackable module with a wall that has a bottom and a top. A support module has a bottom configured and disposed to engage a substrate, and a top configured and disposed to engage the bottom of the stackable module. With this configuration, the support module and the stackable module form a first fence.

16 Claims, 6 Drawing Sheets

FIG. 5
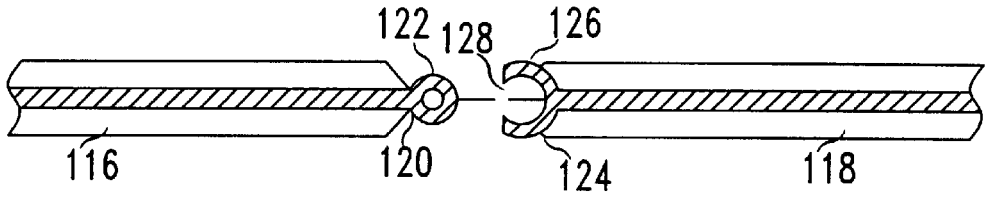
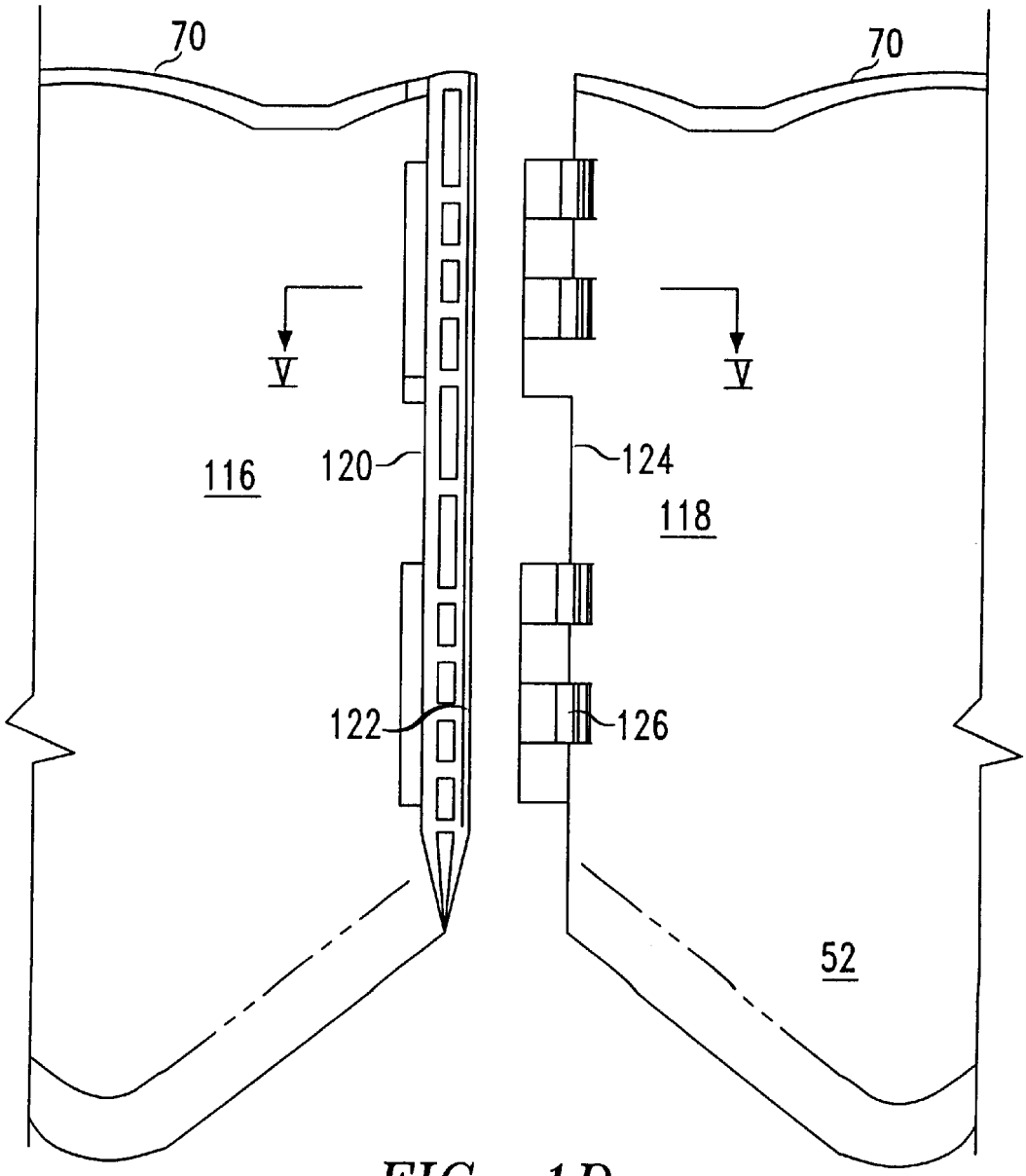
FIG. 1D

MODULAR GARDEN BORDER SYSTEM

BACKGROUND

The present invention relates generally to garden border fences that define a garden border for separating the garden from other landscaping, and for protecting the garden from damage. More particularly, the present invention relates to a garden border that utilizes a modular system to provide a variation in heights, aesthetics, strength and weed control.

Garden fences are known and used to divide a garden from surrounding landscape areas such as lawn, sidewalk, or driveway. The known, picket-type fences are usually short, about one foot high for example, and typically include vertical studs fastened to horizontal braces made of wood slats. Some of the studs have a pointed or sharpened lower end for being driven into the ground to support the fence in an upright position. Molded plastic fencing of this type is also known. The conventional garden fence is provided for aesthetics, and for providing a clear sign of the border of the garden so that people will not accidentally step into the garden.

The conventional garden fence, however, has many disadvantages. First, when the gardener wishes to change the length, height or style of the garden fence, the gardener must either completely replace the old structure with a new fence or custom made fence, or modify the conventional wood fence. This can be cumbersome and time consuming to the average residential gardener, especially those who do not have the wood cutting skills required.

Second, exposed edges of the wood or nails, as well as peeling paint, may be dangerous to children or others who come in contact with the garden fence. In addition, painting is also time consuming and adds additional costs.

Third, during installation of the fence, whether made of wood or plastic, the studs used as stakes are often split or broken when a hammer is used to pound the stakes into the ground. Furthermore, in the typical garden fence, the stakes are relatively easily pulled out of the ground when the fence is bumped or stepped on.

Rather than a garden fence, a garden border may be constructed of a solid edging material. The conventional edging is brick, wood or plastic and usually extends only a few inches above the garden floor and surrounding landscape. In addition to the purposes mentioned above for using the garden fence, the solid edging, which includes a subsurface barrier portion, is also used to prevent the propagation of weeds. This is accomplished by preventing the roots of plants in the ground outside of the garden from growing inside of the garden. The edging also retains garden plants from growing beyond the garden border. Furthermore, edging is used to retain soil or mulch material, such as wood chips or stones, within the garden boundaries.

Conventional edging, however, also has its disadvantages. The typical edging is meant to be used instead of, rather than integrated with, a garden fence. Thus, the combination of the two is not aesthetically pleasing. Furthermore, the plastic and brick type of edging is time consuming to install because it first requires the digging of a ditch along the border of the garden so that a portion of the plastic or brick can be buried. Moreover, bricks are heavy and cumbersome and also may move when bumped by lawn mowers for example. Finally, wooden and plastic edging can split or break when it is pounded into the ground, and only lasts for a few years.

Thus, a main object of the present invention is to provide an improved modular garden border system that provides a number of different configurations including length, height and style adjustability while requiring relatively little time and skill to assemble.

A further object of the present invention is to provide an improved modular garden system that has an edging integrated with fence modules to combine the advantages of fence and edging, as well as to provide an aesthetically pleasing appearance when the edging and fence are combined.

Another object of the present invention is to provide an improved modular garden border system that eliminates the need for paint, requires very little maintenance and eliminates sharp edges.

Yet a further object of the present invention is to provide an improved modular garden border system that will not break during assembly and will not fall or be uprooted easily once the border system is assembled and placed in the ground.

Yet another object of the present invention is to provide an improved modular garden system having an edging that prevents propagation of weeds and retains garden soils without the need to dig ditches for inserting the edging into the ground.

SUMMARY OF THE INVENTION

The above-listed objects are met or exceeded by the present modular garden border system which presents an aesthetically pleasing and easily installed combination of edging and fence. Only a support module (either stakes or edging) need be driven into the ground. At least one vertically stackable fence module is easily and matingly engaged upon the support module. This prevents damage to the fence or stackable modules.

In order to provide variations in appearance, a top module is provided that has a top different than the top of the first module. Either module can be attached directly to the support module. In the alternative, the top module can be attached to the top of the stackable module which in turn is attached to the top of the support module.

More specifically, the present modular garden border system includes at least one stackable module with a wall that has a bottom and a top. A support module has a bottom configured and disposed to engage a substrate and a top configured and disposed to engage the bottom of at least one stackable module so that the support module and the stackable module form a first fence.

As another alternative, the stackable modules can be attached to each other so that a number of stackable modules can be stacked above the support module, with or without the top module on the very top of the stack. Many more combinations can be created by the gardener.

The support module can either be an edging module or stakes. For edging modules, a solid wall is provided to prevent propagation of weeds. The tops of the edging and stakes are thickened and the bottoms of the edging and stakes have inclined edges that converge to downward shaping points for driving the edging and stakes into the ground or substrate. The top of the edging and stakes also have connectors so that the stackable module or the top module can simply be snapped into place on top of the support module for easy assembly. Stakes and edging modules also have vertical ribs for added support and upwardly pointing barbs to prevent uprooting.

Stackable and top modules also have connectors at free stud ends and free ends of horizontal braces. A buckle type connection is used that includes corresponding tongues that lock into receptacles for vertical stacking and horizontal attachment between laterally adjacent first and top modules. Thus, the tops of the support modules and stackable modules lock into the receptacles on the bottoms of the stackable modules and top modules. This provides vertical continuity by stacking the modules.

Similarly, edging modules have pins on one longitudinal end and grooves on another longitudinal end so that modules can be connected end-to-end to create horizontal continuity in the border system.

BRIEF DESCRIPTION OF THE DRAWINGS

FIG. 1D is an exploded close up view of a fourth connection between modules shown in FIG. 1;

FIG. 5 is cross section of the fourth connection shown in FIG. 1D taken along the line V—V and in the direction indicated generally.

DESCRIPTION OF THE PREFERRED EMBODIMENT

Figure 1:
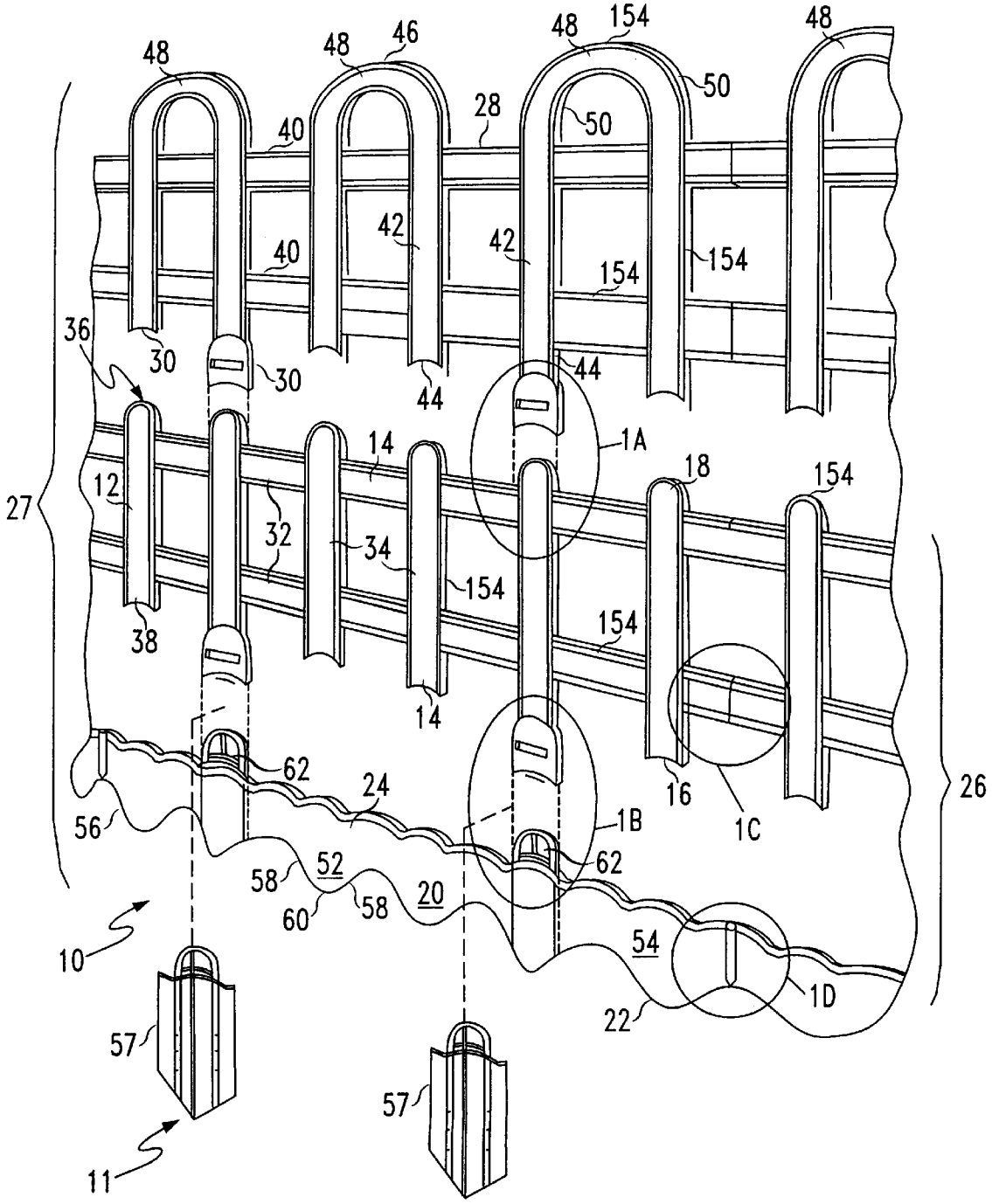
FIG. 1 is an exploded perspective view of the present modular garden border system including a perspective view of an alternative support module.

Referring now to FIG. 1, a modular garden border system is generally designated 10. The border system 10 is placed where a garden meets another type of landscape such as a lawn, walkway, sidewalk, driveway, another garden containing a different type of vegetation or another garden area that has a floor at a different elevation than the present garden.

The modular garden border system 10 has at least one, stackable module 12 having a wall 14 with a bottom 16 and a top 18. A support module 20 is also provided and has a bottom 22 configured and disposed to engage a substrate such as the ground or a garden bed (not shown), and a top 24 configured and disposed to engage the bottom 16 of the stackable module 12 so that the support module 20 and the stackable module 12 form a first fence 26.

In the preferred embodiment, the border system 10 also includes at least one top module 28 having a bottom 30 engagable on either the top 18 of the stackable module 12 or the top 24 of the support module 20. Thus, the gardener can elect to attach the top module 28 to either the top 18 of the stackable module 12 or the top 24 of the support module 20. The combination of top module 28, stackable module 12, and support module 20 forms a second fence 27 shown in FIG. 1.

Referring again to FIG. 1, the stackable module 12 preferably includes horizontal braces 32 that are preferably integrally formed with vertically extending studs 34 in order to support the studs. The studs 34 have upper free ends 36 and lower free ends 38. Thus, the top 18 of the stackable module 12 is defined by the upper free ends 36 of the studs 34. This configuration provides a picket fence type of appearance.

The top module 28 also has horizontal braces 40 preferably integrally formed with vertical studs 42; the studs also having free lower ends 44. A portion on the top module 28, however, has a different shape than a corresponding portion on the stackable module 12 in order to provide a different aesthetic appearance or style. More specifically, instead of the upper free ends 36 of studs 34 as on the stackable module 12, a top 46 of the top module 28 further includes arcuate members 48 that connect upper ends 50 of adjacent studs 42 to form an inverted U-shape. This configuration provides a cathedral fence type of appearance.

Figure 1A:
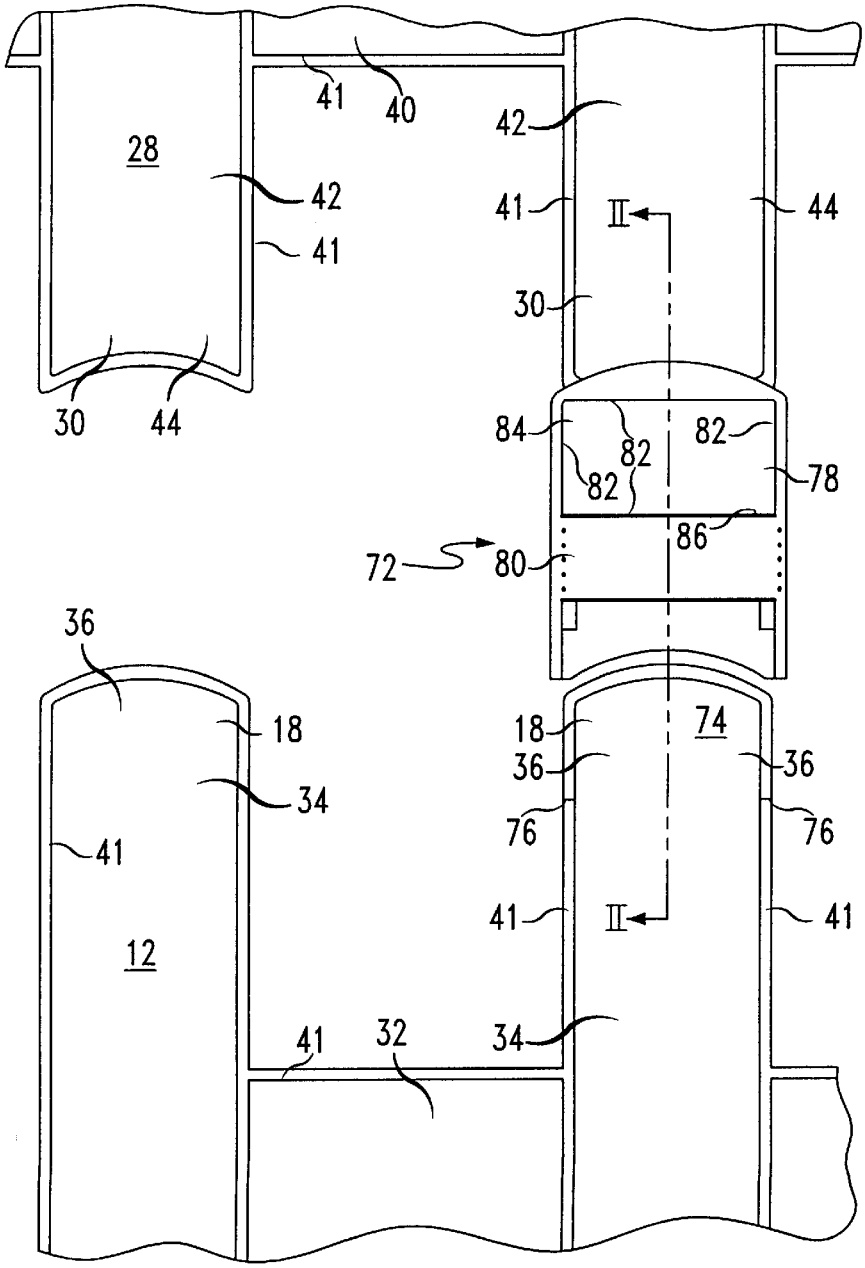
FIG. 1A is an exploded close up view of a first connection between modules shown in FIG. 1.

As best seen in FIG. 1A, the studs 34, 42 and braces 32, 40 have integrally formed raised ribs 41 extending normally to a plane defined by the wall 14. These raised ribs 41 provide added strength and support to the studs and braces.

Referring again to FIG. 1, the support module 20 is preferably an edging module 52 with a solid, generally vertically extending wall or solid wall 54. The bottom 22 of the support module 20 also includes a horizontal zig-zag pattern 56 that has a plurality of inclined edges 58 configured and disposed so that pairs of the inclined edges converge to define downward facing points 60 for engaging the substrate (not shown). It will be appreciated that the wall 54 need not be completely solid. Wall 54 only needs to have enough solid portions in strategic locations to provide adequate strength and prevent root propagation.

Figure 1B:
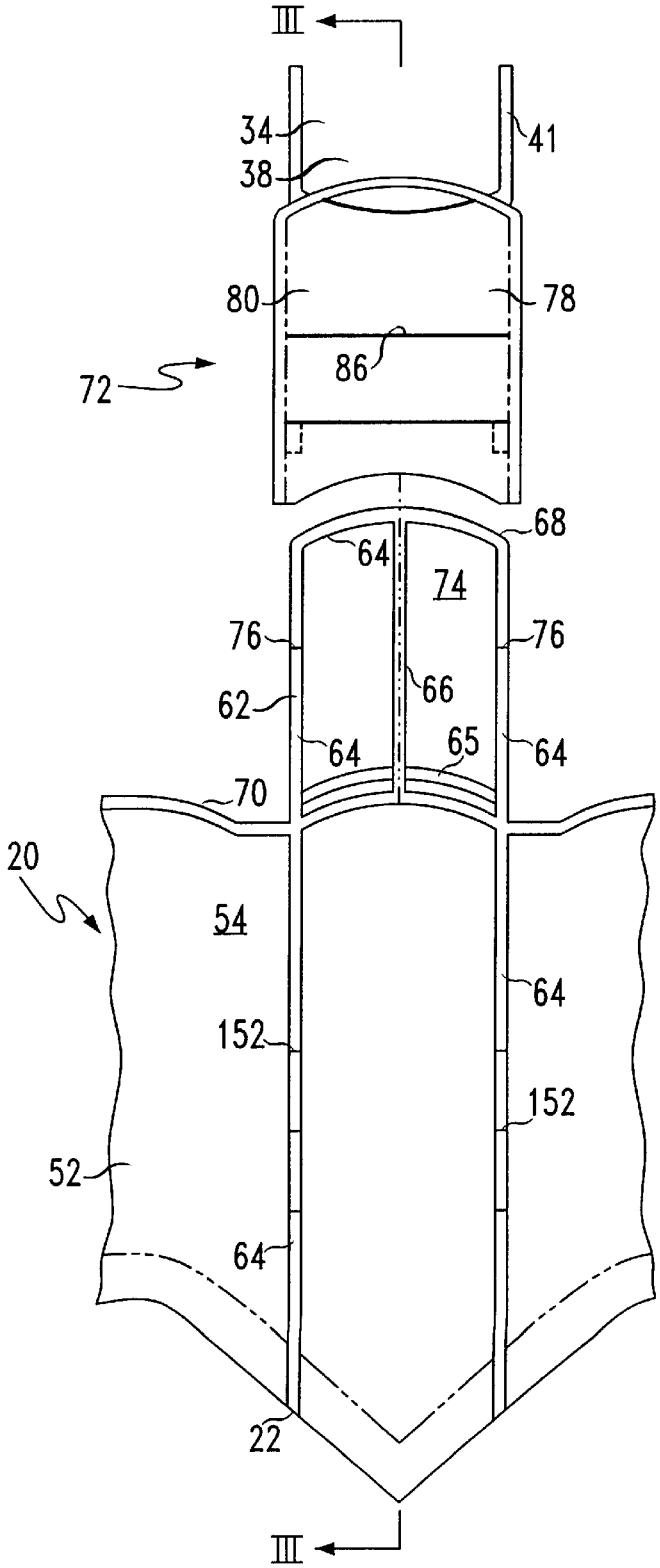
FIG. 1B is an exploded close up view of a second connection between modules in FIG. 1.

Referring now to FIG. 1B, vertical, upward extending mounting lugs 62, preferably integrally formed with the wall 54, are provided for selectively engaging either the stackable module 12 or the top module 28. Raised, normally projecting ribs 64 preferably extend all along the sides of the lugs 62 and down to the bottom 22 of the support module 20, and a raised rib 66 extends from a top 68 of the lug 62 to the top 70 of the wall 54. The ribs 64, 66 provide added strength when a hammer is used to hit the top 68 of the stud 62 to drive the edging module 52 into the ground (not shown). A lateral raised rib 65 is also provided for lateral strength and is preferably located adjacent to the top 20.

Figure 2:
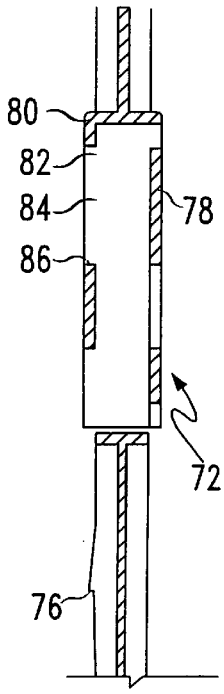
FIG. 2 is a cross section of the first connection shown in FIG. 1A taken along the line II—II and in the direction indicated generally.

Referring now to FIGS. 1A and 2, a close-up view is provided of the connection between the stackable module 12 and the top module 28. A connector 72 is preferably a plug and socket or buckle type, and incorporates the upper ends 36 of the studs 34 as the "plug" or "male" portion of the connector. The upper ends 36 of the studs 34, including the raised ribs 41, act as an upwardly extending tongue 74 for the buckle connection 72. Both raised ribs 41 to be used for the connection 72 preferably have a raised barb formation 76.

As shown in FIG. 1A, lower free end 44 of the stud 42 on the top module 28 has a downwardly extending receptacle 78 configured for mating with one of the upwardly extending tongues 74. The receptacle 78 has a front portion 80 with peripheral walls 82 that define an aperture 84 including a bottom most horizontal peripheral wall 86. When the tongue 74 is fully inserted into the receptacle 78, the barb formations 76 lockingly engages the aperture 84 at the peripheral wall 86, which locks the tongue 74 in the receptacle 78. It will be appreciated that other types of convenient connections are possible.

It will also be appreciated that rather than the top module 28 as shown in FIGS. 1 and 1A, another stackable module 12 could be used instead. Thus, FIG. 1A and FIG. 2 also show the configuration for a connector 72 at the bottom of a stud 34 rather than a stud 42. With a plurality of stackable modules 12, a top 18 of each stackable module engages a bottom 16 of any other stackable module 12 in the plurality of stackable modules.

Likewise, the top modules 28 may be placed at the top of a stack of multiple first modules 12. This configuration is achieved by modifying FIG. 1 by inserting at least one other stackable module 12 between the modules 12 and 28 already shown.

With this configuration of connections and modules, the modular garden border system 10 can be selectively vertically stacked in a number of different ways to form different styles and heights. Some of these combinations include the following configurations of modules, each in order from bottom to top: (1) support module, stackable module; (2) support module, top module; (3) support module, stackable module, top module; (4) support module, stackable module, stackable module, top module; (5) support module, followed by any number of stackable modules; and (6) support module, followed by any number of stackable modules, top module. In each of these combinations, the support module 20 could be either the edging module 52 or stakes 57. These combinations provide variations in appearance, shape and height for the border system 10. It will also be appreciated that other combinations not mentioned are possible.

Referring again to FIG. 1, the bottoms 16, 30 of the stackable module 12 and top module 28 are arcuate to match the corresponding arcuate tops 24, 36 of the support module 20 and stackable module 12 respectively. Thus, the studs 34, 42 that do not have connectors 72, rest on the module below that stud 34, 42, respectively. This provides further support to the module 12 or 28 and provides the appearance of a continuous vertical stud from bottom to top of the border system 10.

Figure 3:
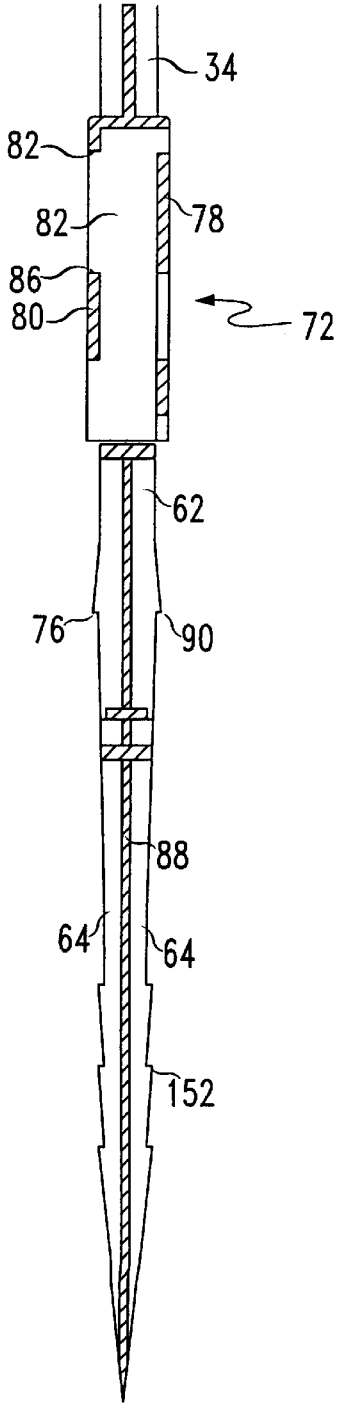
FIG. 3 is cross section of the second connection shown in FIG. 1B taken along the line III—III and in the direction indicated generally.

Referring now to FIGS. 1B and 3, the connection between the edging module 52 and the lower end 38 of the studs 34 is virtually identical to the connection between the top module 28 and the first module 12. Thus, description of the same parts of the connector 72 already described will not be repeated.

An additional feature of the edging module 52 is that it also has a backside 88 with another barb formation 90 on raised ribs 64. This permits the receptacle 78 to be attached to the other modules 12, 28 no matter which direction, front or back of the edging module 52, the aperture 84 faces.

Figure 1C:
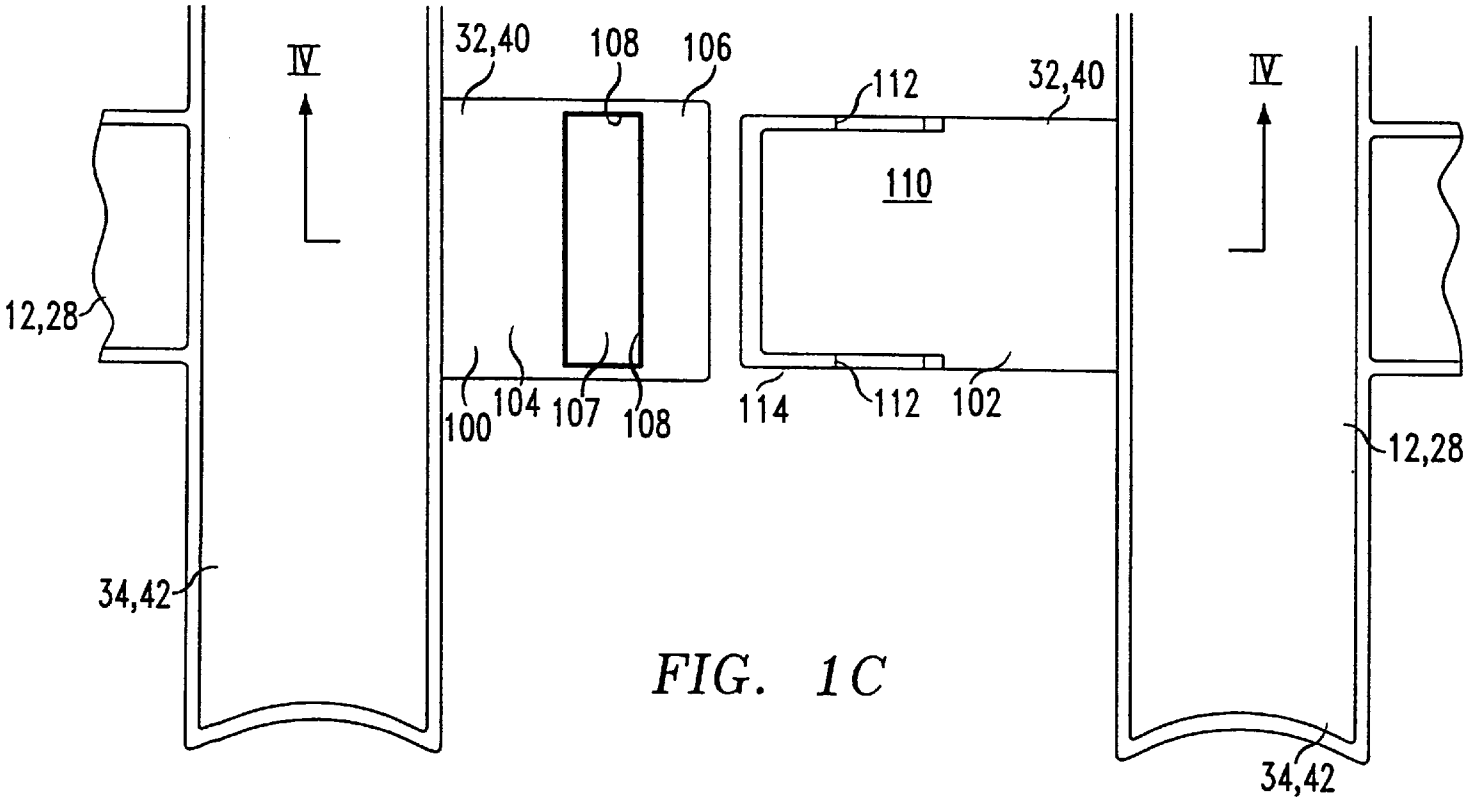
FIG. 1C is an exploded close up view of a third connection between modules shown in FIG. 1.
Figure 4:
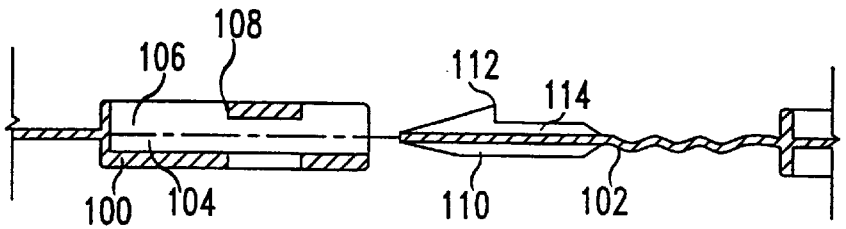
FIG. 4 is a cross section of the third connection shown in FIG. 1C taken along the line IV—IV and in the direction indicated generally.

Referring now to FIGS. 1C and 4, each horizontal brace 32, 40 of the stackable modules 12 and top modules 28 includes a longitudinal first end 100 and a longitudinal second end 102. The first end 100 has a laterally extending receptacle 104, similar to the receptacle 78, including a front portion 106 with peripheral walls 108 that define an aperture 107. Similarly, the second end 102 has a laterally extending tongue 110 with barb formations 112 on raised ribs 114. The tongue 110 mates with the receptacle 104 so that the barb formations 112 lockingly engage the aperture 107.

Referring now to FIGS. 1D and 5, the edging module 52 has two longitudinal ends 116, 118. A vertical first edge 120 is located on the first longitudinal end 116, and a generally cylindrical pin 122 extends along the vertical first edge 120. Similarly, the second longitudinal end 118 has a vertical second edge 124 and plurality of vertically spaced, arc clamps 126 disposed along the vertical second edge 124. Best seen in FIG. 5, the clamps 126 extend laterally from the vertical second edge 124 to define a groove 128. The pin 122 is configured to be tightly received in the groove 128.

Referring again to FIG. 1, another aspect of the present invention is shown and generally designated 11. Shared components of the border system 10 are designated with identical reference numbers. The main difference between the systems 10 and 11 is that instead of the support module 20 being an edging module 52, the support module includes vertically extending stakes 57.

Figure 1E:
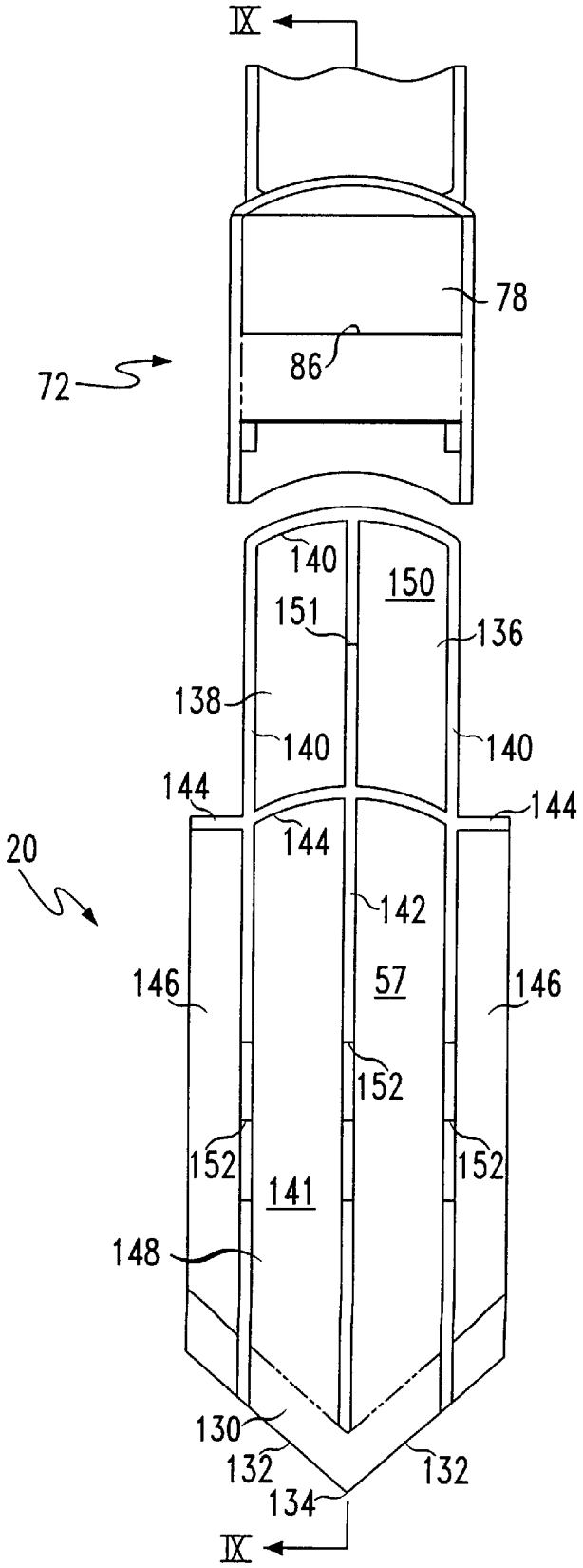
FIG. 1E is an exploded close up view of a connection between modules shown in FIG. 1.
Figure 6:
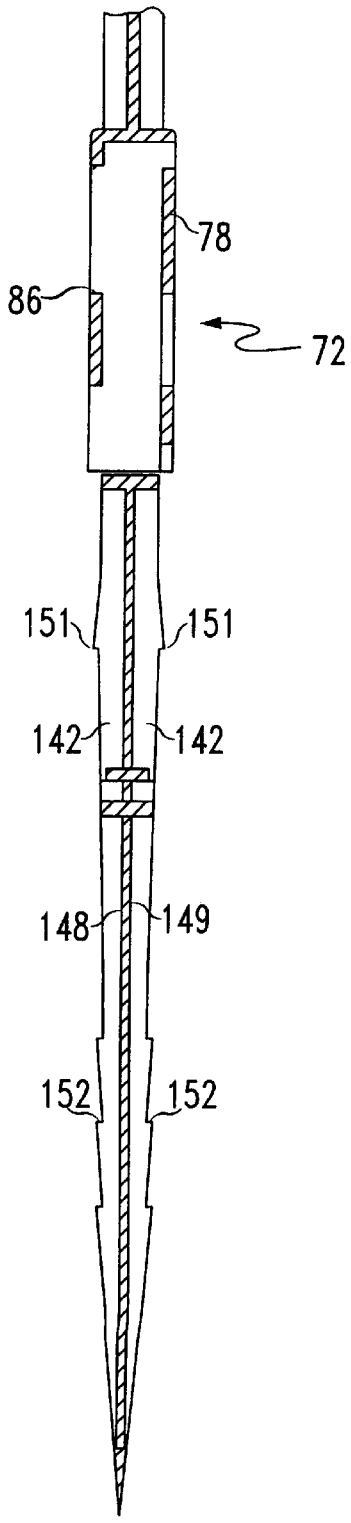
FIG. 6 is a cross section of the connection shown in FIG. 1E taken along the line VI—VI, and in the direction indicated generally.

As best seen in FIGS. 1E and 6, a bottom 130 of the stake 57 has inclined edges 132 converging into a downward facing pointed tip 134. A top 136 of the stake 57 has a vertically extending mounting lug 138 for engaging either the stackable module 12 or the top module 28. The lug 138 has raised ribs 140 similar to the raised ribs 64 on the edging module 52, that extend normally along a stake wall 141 to the bottom 130 of the stake. However, a center raised rib 142 on the stakes 57 also extends to the bottom 130 of the stake 57, in contrast to the center rib 66 on the edging module 52 that preferably stops at the top 70 of the edging module 52.

In addition, the stakes 57 also have lateral raised ribs 144 that extend along the top of wings 146. The ribs 140, 142 are generally evenly spaced and extend along the front face 148 and the back face 149 of the stakes 57. The ribs 140, 142, 144 and wings 146 provide added vertical and lateral strength for driving the stake 57 into the ground and supporting the stackable modules 12 and top modules 28.

Referring again to FIGS. 1E and 6, a connector 72 is the same as the connector 72 used for attachment to the edging module 52, except that a barb formation 148 for locking is placed on the center raised rib 142, rather than the two outer ribs 140. Thus, only one barb formation 151 engages a peripheral wall 86 to lock the tongue 150 in a receptacle 78. It will be appreciated that barb formations can be placed in many different locations along the lugs 62, 138 and studs 34, 42.

Referring again to FIGS. 1B, 3, 1E and 6, each rib 64, 140 and 142 that extends along the walls 54 and 141 has preferably three upwardly extending barbs 152. The barbs 152 provide further resistance to uprooting forces that drive the stakes 57 or edging 52 upward and out of the ground or floor.

Referring again to FIGS. 1B and 1E, tops 68, 70, 140, 144 of the support module 20 are wider than a bottom 22, 130 of the support module so that an enlarged contact area is provided for hitting the tops with a hammer for driving the bottoms of the support module though the ground or floor.

The modular garden border system can stand in a substrate (not shown) such as the ground, dirt, soil, gravel, stones, sand, wood chips, bark or any other granular material. It will be appreciated that any substrate can be used as long as the stakes and the edging module can penetrate the top or floor surface of the substrate.

Referring again to FIG. 1, all edges exposed above the ground are rounded or radiused to eliminate sharp cutting edges. The modules are also preferably made of molded hard, durable, plastic.

Thus, the present modular garden border system provides several features designed to address particular problems that arise with garden fencing and edging. These features include different modules 12, 20, 28 and 57 that can be mixed and matched to form a number of different combinations resulting in different styles and heights as well as variable lengths. In addition, tongue and receptacle connections 72, connectors 104, 110 and connectors 122, 126 provide for quick and easy assembly. Furthermore, the modules 12, 20, 28, when made of sturdy molded plastic, do not require paint for easy maintenance.

Moreover, raised ribs 41, 64–66, 68, 140, 142 and 144 add strength to the modules to prevent breaking when driving them into the ground, and barbs 152 prevent easy uprooting of the fence. Also, the edging 52 has a wall 54 preventing the propagation of plants into the garden while using an zig-zag pattern 56 for driving into the ground to avoid the necessity of digging a ditch to bury the edging module. Finally, the edging module 52 is also aesthetically pleasing alone or in combination with the modules 12 and 28.

While a particular embodiment of the modular garden border system of the invention has been shown and described, it will be appreciated by those skilled in the art that changes and modifications may be made thereto without departing from the invention in its broader aspects and as set forth in the following claims.

What is claimed is:

1. A modular garden border system dividing a garden from another landscape area, comprising:

at least one stackable module having a wall with a bottom and a top, said wall being defined by a plurality of spaced, generally horizontal braces, and a plurality of spaced, generally vertically extending studs, secured to said braces, said bottom including at least one receptacle;

at least one support module lacking said braces and said vertical studs and having a bottom configured and disposed to engage a substrate, and a top having at least one lug configured and disposed for matingly engaging one of said receptacles formed on said bottom of said stackable module so that said support module and said stackable module form a first fence.

2. The modular garden border system according to claim 1, further comprising at least one top module having a top and a bottom defining a receptacle engagable on either of said top of said stackable module or a corresponding one of said lugs of said support module so that said top module, said stackable module, and said support module are connectable to form a second fence.

3. The modular garden border system according to claim 2, wherein said top module further includes a plurality of horizontal braces, and a plurality of vertical studs supported by said horizontal braces, each said stud having upper ends and lower free ends.

4. The modular garden border system according to claim 3 wherein said top of said top module further includes arcuate members that connect said upper ends of adjacent said studs to form an inverted U-shape.

5. The modular garden border system according to claim 2, wherein said support module is an edging module with a solid, generally vertically extending wall, said bottom of said support module further including a horizontal zig-zag pattern having a plurality of inclined edges configured and disposed so that pairs of said inclined edges converge to define downward facing points.

6. The modular garden border system according to claim 5, wherein said mounting lugs are integrally formed with said wall of said edging module.

7. The modular garden border system according to claim 2, wherein said support module is at least one vertically extending stake, a bottom of said stake further having inclined edges converging into a downward facing tip and a top of said stake further forming a mounting lug for engaging said bottom of either of said stackable module or said top module.

8. The modular garden border system according to claim 7, wherein said stake further includes a front face, a back face, and at least one vertically extending rib on at least one of said front and back faces, each said rib having at least one upward extending barb.

9. The modular garden border system according to claim 2, wherein said support module further includes a longitudinal first end and a longitudinal second end, said first end having a vertical first edge and a generally cylindrical pin extending along said vertical first edge, and said second end having a vertical second edge and a plurality of vertically spaced, arc clamps disposed along said vertical second edge, said clamps extending laterally from said vertical second edge to define a groove, said pin configured to be tightly received in said groove.

10. The modular garden border system according to claim 2, wherein said bottom of said stackable module and said bottom of said top module each further includes at least one downwardly extending receptacle, and wherein said top of said support module further includes at least one upwardly extending mounting lug and said top of said stackable module further includes at least one upwardly extending tongue, each said mounting lug and said tongue being configured for mating with one said downward extending receptacle.

11. The module garden border system according to claim 10, wherein each said receptacle has a front portion with peripheral walls that define an aperture, said tongue and said mounting lug each having a barb formation that lockingly engages said aperture.

12. The modular garden border system according to claim 2, wherein said modules are configured so that the modular garden border system is selectively vertically stackable in all the following configurations of modules, each in order from bottom to top: said support module, said stackable module; said support module, said top module; said support module, said stackable module, said top module; said support module, said stackable module, said stackable module, said top module; said support module, followed by any number of said stackable modules; and said support module, followed by any number of said stackable modules, said top module, wherein said support module includes either stakes or said edging modules.

13. The modular garden border system according to claim 2, wherein each said stackable module and said top module further includes longitudinal first and second ends, each said first end having at least one laterally extending receptacle, and each said second end having at least one laterally extending tongue for mating with one said receptacle.

14. The modular garden border system according to claim 13, wherein each said receptacle has a front portion with peripheral walls that define an aperture, each said tongue having a barb formation that lockingly engages said aperture.

15. The modular garden border system according to claim 1, wherein said top of said support module further is wider than said bottom of said support module, whereby said widening of said top provides an enlarged contact area for hitting said tops with a hammer for driving said bottom of said support module into the substrate.

16. A modular garden border system dividing a garden from another landscape area, comprising:

at least one stackable module having a wall with a bottom and a top; and a support module having a bottom configured and disposed to engage a substrate, and a top configured and disposed to engage said bottom of said stackable module so that said support module and said stackable module form a first fence;

at least one top module having a top and a bottom engagable on either of said top of said stackable module or said top of said support module so that said top module, said stackable module, and said support module are connectable form a second fence;

wherein said support module further includes a longitudinal first end and a longitudinal second end, said first end having a vertical first edge and a generally cylindrical pin extending along said vertical first edge, and said second end having a vertical second edge and a plurality of vertically spaced, arc clamps disposed along said vertical second edge, said clamps extending laterally from said vertical second edge to define a groove, said pin configured to be tightly received in said groove.

* * * * *